US005771592A

United States Patent [19]

Nizker

[11] Patent Number: 5,771,592

[45] Date of Patent: Jun. 30, 1998

[54] RAZOR PROTECTIVE SEAL

[75] Inventor: Ilya Nizker, Orange, Conn.

[73] Assignee: Warner-Lambert Company, Morris Plains, N.J.

[21] Appl. No.: 564,691

[22] Filed: Nov. 29, 1995

[51] Int. Cl.[6] ..... B26B 21/00

[52] U.S. Cl. ..... 30/540; 206/349

[58] Field of Search ..... 30/90, 32, 84, 30/77, 537, 539, 540; 206/228, 208, 352, 349, 353, 807

[56] References Cited

U.S. PATENT DOCUMENTS

| | | | |
|---|---|---|---|
| Re. 32,367 | 3/1987 | Bowman et al. . | |
| 2,321,570 | 6/1943 | Billing | 206/208 |
| 2,551,859 | 5/1951 | Thompson | 206/208 |
| 2,849,109 | 8/1958 | Rommel | 206/352 |
| 3,339,608 | 9/1967 | Brenner | 206/352 |
| 3,399,455 | 9/1968 | Steere, Jr. . | |
| 3,675,323 | 7/1972 | Braginetz . | |
| 3,703,765 | 11/1972 | Perez . | |
| 3,823,471 | 7/1974 | Stone | 30/85 |
| 4,170,724 | 10/1979 | Waterbury | 206/807 |
| 4,197,947 | 4/1980 | Zaidi | 206/807 |
| 4,496,047 | 1/1985 | Gatley | 206/208 |
| 4,509,196 | 4/1985 | Sak et al. | 206/807 |
| 4,511,052 | 4/1985 | Klein et al. | 206/807 |
| 4,601,392 | 7/1986 | Althaus | 206/352 |
| 4,622,742 | 11/1986 | Lee . | |
| 4,721,208 | 1/1988 | Thorpe | 206/353 |
| 4,777,722 | 10/1988 | Trotta | 30/90 |
| 4,809,432 | 3/1989 | Schauble . | |
| 4,972,968 | 11/1990 | Iten | 221/97 |
| 5,012,578 | 5/1991 | Siefer . | |
| 5,095,621 | 3/1992 | Rapp | 30/90 |
| 5,222,600 | 6/1993 | Stoddard et al. | 206/370 |
| 5,265,759 | 11/1993 | Coffin | 221/123 |
| 5,366,087 | 11/1994 | Bane | 206/807 |
| 5,595,297 | 1/1997 | Borck et al. | 206/807 |

FOREIGN PATENT DOCUMENTS

| | | | |
|---|---|---|---|
| 108313 | 8/1939 | Australia | 206/208 |
| 1021731 | 2/1953 | France | 206/208 |
| 2506976 | 8/1975 | Germany . | |
| 3-14466 | 1/1991 | Japan | 206/807 |
| 3-289465 | 12/1991 | Japan | 206/807 |
| 76529 | 11/1954 | Netherlands | 206/208 |
| 75742 | 7/1930 | Sweden | 206/208 |
| 569875 | 6/1945 | United Kingdom . | |
| 2218935 | 11/1985 | United Kingdom . | |
| 2231297 | 11/1990 | United Kingdom . | |

*Primary Examiner*—Maurina T. Rachuba
*Attorney, Agent, or Firm*—Charles W. Almer

[57] ABSTRACT

The present invention is directed to a method of maintaining a cover on the razor head of a wet shave razor. Such a cover is used to prevent damage to the cutting edge of the razor and to prevent accidental contact with the cutting edge when the razor is not in use. The present invention is also directed to a razor unit having a cover which is semi-permanently affixed to the razor head via a protective seal. The cover is affixed to the razor head during manufacture in a position such that it covers the cutting edges of the blades. Preferably, the cover is affixed through the use of an adhesive strip or strips which are attached to the cover and the razor head. The user must manually remove or break the adhesive strip in order to remove the cover to expose the cutting edge and begin shaving.

6 Claims, 1 Drawing Sheet

RAZOR PROTECTIVE SEAL

FIELD OF THE INVENTION

The present invention relates to wet shave razors, and in particular to wet shave razors having a protective seal which aids in protecting the blade or blades prior to use.

BACKGROUND OF THE INVENTION

Wet shave razors having covers protecting the cutting edges of the razor blades have been commercially produced for many years. Razors with such covers include both disposable and non-disposable versions, as well as those with either single or multiple blades. Generally, razor covers snap or slide onto the razor head in such a manner whereby the sharpened edges of the blade or blades is covered. The covers are utilized in order to protect the cutting edges of the blades from being damaged during manufacturing, shipping, sales and mishandling by the user. Such protection is important because any damage to the cutting edge may lead to an uncomfortable shave and possibly even injury to the user. The cover also serves the important purpose of protecting the user from the sharp cutting edges when the razor is not in use.

A problem with currently used covers is that they occasionally fall or slide off of the razor head during shipping or other interim steps prior to actual use. In the event that the cover is missing, the user is faced with the dilemma of not knowing whether the cutting edge has been damaged or previously used. Consequently, many users will discard a new razor without using that razor simply because it has no cover. A further problem relates to safety and consumer perception. Many institutions, such as hotels and health clubs, often provide disposable razors to their customers. The cover on the razor, which may be easily removed and replaced, is the only indication to the user that the razor is new and has not been previously used. Because the cover may be so easily removed and replaced, the user cannot be certain that the razor has not previously been used by another person.

It would therefor be desirable to provide a method for fastening a cover on a wet shave razor in a manner such that the cover would be easily removable accidentally during manufacture, shipping or other interim steps. It would further be beneficial to provide a wet shave razor with a cover which would be initially affixed with a protective seal in a manner such that the removal or the protective seal would indicate to the user that the razor may have been previously used.

SUMMARY OF THE INVENTION

The present invention is directed to a method of maintaining a cover on the razor head of a wet shave razor. Such a cover is used to prevent damage to the cutting edge of the razor and to prevent accidental contact with the cutting edge when the razor is not in use. The present invention is also directed to a razor unit having a cover which is semi-permanently affixed to the razor head via a protective seal. The cover is affixed to the razor head during manufacture in a position such that it covers the cutting edges of the blades. Preferably, the cover is affixed through the use of an adhesive strip or strips which are attached to the cover and the razor head. The user must manually remove or break the adhesive strip in order to remove the cover to expose the cutting edge and begin shaving.

DETAILED DESCRIPTION OF THE PREFERRED EMBODIMENTS

Figure 1:
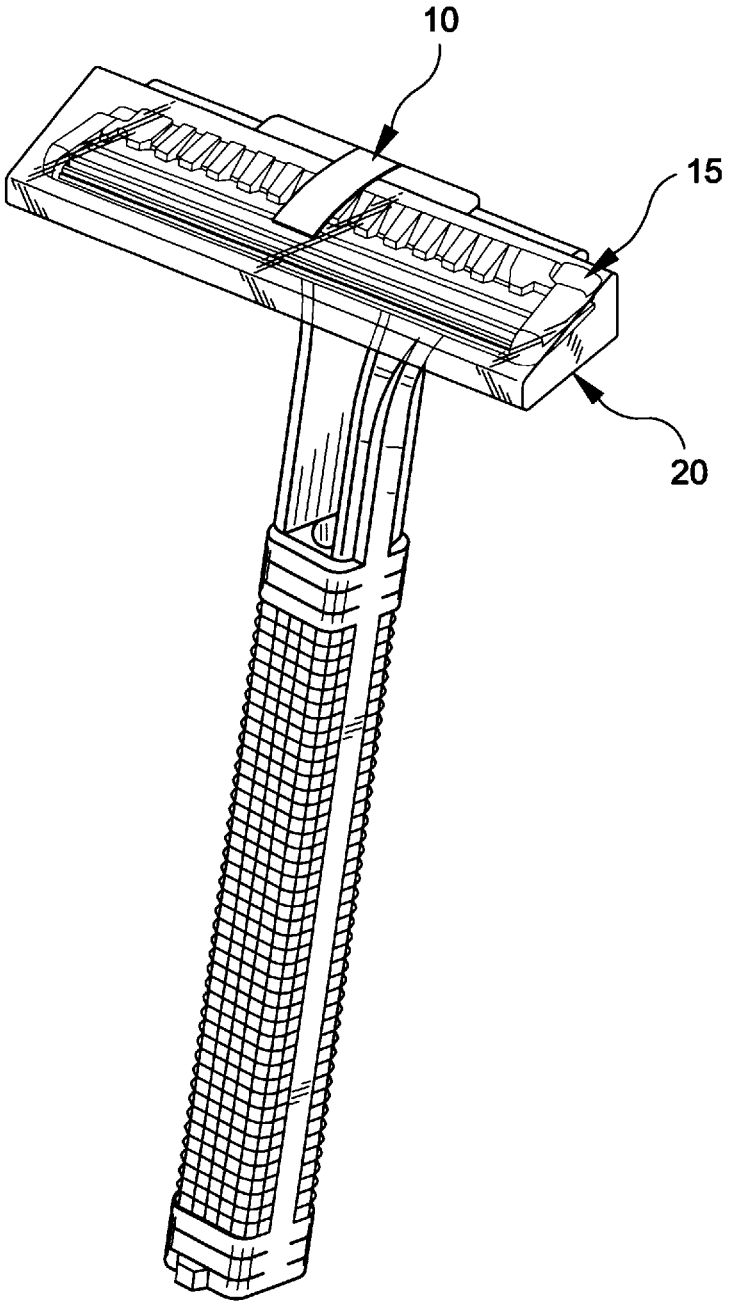
FIG. 1 is a perspective view of a razor head having the protective seal of the present invention.

The present invention is directed to a wet shave razor having a cover on the razor head and a method of securing a cover on a wet shave razor. For the purpose of this invention, "wet shave razor" refers to a non-powered razor with which one generally uses a material such as shaving cream or foam and water to shave. "Razor head" refers to the portion of the razor which is either permanently or removably attached to the handle and which contains the razor blade or blades. Included within the scope of razor head are both removable razor cartridges and non-removable razor cartridges which may be integrally molded with the razor handle. "Cover" refers to a device which may be affixed to the razor head in a manner so as to protect the cutting edge of the blades.

As illustrated in FIG. 1, a means for semi-permanently affixing the cover 20 to the razor head 15 is provided. In a preferred embodiment, the means for affixing the cover is a protective seal 10, preferably comprising one of more adhesive strips. The cover and protective seal should be applied to the razor unit early in its life, preferably during manufacture. The early application will reduce the risk of damage to the cutting edges prior to the placement of the cover. The protective seal is placed on the unit in a manner such that the cover may not be removed without removing or damaging the strip. Preferably, one portion of the protective seal is attached to the razor head and another portion of the protective seal is attached to the cover. Further, the protective seal may be placed at any point along the length of the cover. In the case of a cover which slides onto the unit, the protective seal may be placed at the end of the razor head. Attachment in this manner results in a protective seal in the form of a semi-permanently affixed cover which may only be removed through direct action, preferably manual intervention. Such manual intervention would preferably consist of a relatively simple act such as peeling the adhesive off of either the cover or the razor head to separate the pieces.

In a further preferred embodiment, one end of the adhesive of the protective seal is permanently affixed to the cover and the other end is permanently affixed to the razor unit. In order for the user to use the razor, he or she must break the protective seal which will result in a permanent visual indication to potential future users that the razor has been used, or at the very least, that the cover has been removed.

In a still further embodiment, the means for affixing the cover may consist of a shell or wrapper which the user must remove from the razor head and cover prior to use. A hard shell which requires the user to perform manual manipulations, such as twisting or breaking the shell off, may be employed. Once such a shell was removed from the razor head, the cover would be independently removable and replaceable, as with current systems. As with the previous embodiments, the potential user would have a permanent, visual indication as to whether or not the razor had been previously used.

Consumers will benefit from the present invention in that they will be easily able to determine whether or not the razor has been previously used by whether the protective seal has been broken. Currently, consumers who purchase razors having covers which may have fallen off during transport are unable to know whether the cover simply fell off the razor or whether the razor was previously used by another. In addition, a consumer purchasing a razor without a cover currently runs the risk, upon using the razor, that the cutting edge was damaged at some point. The present invention virtually eliminates the possibility that the cover will accidentally fall off of the razor head. Consequently, the invention eliminates the fear of using a razor with a damaged cutting edge and alleviates any consumer anxiety regarding a razor unit having no cover. In addition to the general public, institutions, such as hotels, hospitals and health clubs, will benefit from the present invention in that they may offer their clients razors having a protective seal with an assurance that the razor has not been previously used. This will result in a further monetary savings in that only those razors with broken or missing protective seals will need to be discarded and further environmental savings in that landfills will not be needlessly clogged with good, unused razors.

While there have been described what are presently believed to be the preferred embodiments of the invention, those skilled in the art will realize that various changes and modifications may be made to the invention without departing from the spirit of the invention, and it is intended tb claim all such changes and modifications as fall within the scope of the invention.

I claim:

1. A razor unit comprising:

a razor head having one or more blades;

cutting edges on each of the one or more blades;

a cover capable of enclosing and protecting the cutting edges of the blades;

one or more protective seal means which has two more portions wherein one portion of the seal means is attached to the razor head and the other portion of the seal means is attached to the cover to affix the cover to the razor head in a manner such that the cover is removable from the razor head only upon the exertion of manual force; and wherein the protective seal means comprises one or more pieces of adhesive material which is in the form of a strip having two ends which is placed on the razor in a location such that a consumer may determine whether or not the cover has been previously removed from the razor head.

2. A razor unit according to claim 1, wherein one end of the strip is releasably affixed to the razor head and the other end of the strip is releasably affixed to the cover.

3. A razor unit according to claim 1, wherein one end of the strip is releasably affixed to the razor head and the other end of the strip is permanently affixed to the cover such that the cover is semi-permanently affixed to the razor head and is removable from the razor head only upon the exertion of manual force.

4. A razor unit according to claim 1, wherein the razor head is integrally formed with a razor handle.

5. A razor unit according to claim 1, wherein the protective seal means comprises a wrapper which encompasses the razor head and cover.

6. A method for semi-permanently affixing a cover to a razor head comprising the step of placing a protective seal means between the razor head and the cover in a manner such that the cover is removable only upon the exertion of manual force.

* * * * *